US007160189B2

(12) United States Patent
Walker et al.

(10) Patent No.: US 7,160,189 B2
(45) Date of Patent: *Jan. 9, 2007

(54) SYSTEMS AND METHODS FOR DETERMINING AN OUTCOME OF A GAME ON A GAMING DEVICE BASED ON A FACTOR OTHER THAN A RANDOM NUMBER

(76) Inventors: Jay S. Walker, 124 Spectacle La., Ridgefield, CT (US) 06877; James A. Jorasch, 25 Forest St., Apartment. 5G, Stamford, CT (US) 06901; Geoffrey M. Gelman, 21 Belltown Rd., Stamford, CT (US) 06905; Magdalena M. Fincham, 3 Valley View Rd., #24, Norwalk, CT (US) 06851

( * ) Notice: Subject to any disclaimer, the term of this patent is extended or adjusted under 35 U.S.C. 154(b) by 674 days.

This patent is subject to a terminal disclaimer.

(21) Appl. No.: 10/317,193

(22) Filed: Dec. 11, 2002

(65) Prior Publication Data

US 2003/0109300 A1 Jun. 12, 2003

Related U.S. Application Data

(63) Continuation-in-part of application No. 09/992,147, filed on Nov. 19, 2001, now Pat. No. 6,511,376, which is a continuation of application No. 09/439,307, filed on Nov. 12, 1999, now Pat. No. 6,343,988, which is a continuation of application No. 08/833,034, filed on Apr. 3, 1997, now Pat. No. 6,010,404.

(51) Int. Cl.
*A63F 9/24* (2006.01)

(52) U.S. Cl. ..... 463/21; 463/16; 463/20; 463/36

(58) Field of Classification Search ..... 463/1, 463/12–13, 16–20, 25, 40–43; 273/292–293, 273/143 R; 340/825.3–825.31, 825.33, 323 R; 700/91–93; 382/115–117, 123–124
See application file for complete search history.

(56) References Cited

U.S. PATENT DOCUMENTS 3,580,581 A 5/1971 Raven ..... 273/138 A (Continued)

FOREIGN PATENT DOCUMENTS

WO WO 97/27569 7/1997

OTHER PUBLICATIONS

Van, John, "Engineers Enlist Magnetic 'Fingerprint' in Effort to Bust Bank-Card Fraud", Chicago Tribune, Jan. 3, 1994, Section: Business, p. 4, Zone: C.

(Continued)

*Primary Examiner*—Mark Sager

(57) ABSTRACT

In accordance with one or more embodiments of the present invention, a player input is used as a value for a variable in an algorithm of a gaming device. The algorithm, in turn, is used to generate a pseudorandom value. The pseudorandom value, in turn, is used to determine an outcome for a game of the gaming device. Accordingly, a player is allowed to influence the outcome of a game by providing an input. The input may comprise, for example, a numeric input, a biometric input, or a physical input. The latter two types of inputs may be converted to a numeric form before being used in the algorithm. In accordance with one or more embodiments, a player input comprises selection of an algorithm for use in generating a pseudorandom value to be used to determine an outcome for a game of a gaming device. In accordance with one or more embodiments, a player input comprises a player selection of a visual representation of a pseudorandom value to be used to determine an outcome for a game of a gaming device.

33 Claims, 13 Drawing Sheets

U.S. PATENT DOCUMENTS

| | | | | | |
|---|---|---|---|---|---|
| 4,448,419 | A | | 5/1984 | Telnaes | 273/143 R |
| 4,560,161 | A | | 12/1985 | Hamano | 273/85 CP |
| 4,695,053 | A | | 9/1987 | Vazquez, Jr. et al. | 273/143 R |
| 4,856,787 | A | | 8/1989 | Itkis | 273/237 |
| 4,922,522 | A | | 5/1990 | Scanlon | 379/95 |
| 4,996,705 | A | | 2/1991 | Entenmann et al. | 379/91 |
| 5,102,134 | A | | 4/1992 | Smyth | 273/138 A |
| 5,229,764 | A | | 7/1993 | Matchett et al. | 340/825.34 |
| 5,269,521 | A | * | 12/1993 | Rossides | 705/14 |
| 5,356,140 | A | * | 10/1994 | Dabrowski et al. | 463/12 |
| 5,373,440 | A | | 12/1994 | Cohen et al. | 364/410 |
| 5,395,110 | A | * | 3/1995 | Yamazaki et al. | 273/108 |
| 5,429,361 | A | | 7/1995 | Raven et al. | 273/138 A |
| 5,470,081 | A | | 11/1995 | Sato et al. | 273/438 |
| 5,524,888 | A | | 6/1996 | Heidel | 463/22 |
| 5,768,382 | A | | 6/1998 | Schneier et al. | 380/23 |
| 6,010,404 | A | | 1/2000 | Walker et al. | 463/21 |
| 6,343,988 | B1 | | 2/2002 | Walker et al. | 463/21 |

OTHER PUBLICATIONS

"Issuers Finally Give Biometrics A Positive ID", Debit Card News, formerly POS News, Jan. 29, 1996, vol. 1, No. 15, pp. 1, 3, 8.

"Smart Cards Meet Biometrics", Card Technology, Sep./Oct. 1996, pp. 30-38.

"XTec and Semtek Unvel The Cube; At Booth 830—Card Tech/SecurTech 2000", Business Wire, May 1, 2000.

Website: "Fruit Machine for the HP-41C", (http //www hpmuseum org/software/41 fruit htm), Copyright 2001.

Website "HotBits: Genuine random numbers, generated by radioactive decay", (http //www fourmilab ch/hotbits/), download date: Dec. 1, 2002.

Websites: "Ross Technologies—Professional Research and Reporting", (http //personal adiis net/rosstech/index htm), download date: Dec. 5, 2002.

Website: "Ross Technologies Slots Report Part 2—Random Number Generator (RNG)", (http //personal adiis net/rosstech/rpt02_ b htm), download date: Dec. 6, 2002.

* cited by examiner

200

| ALGORITHM IDENTIFIER 210 | REQUIRED INPUTS 220 | ALGORITHM 230 |
|---|---|---|
| 1 | PIC, RN, TIME | $(PIC \times RN)^2 \times TIME$ |
| 2 | PIC, RN, K, TIME | $(PIC + RN + K)^2 \times TIME$ |

240

250

FIG. 4

300

| | PLAYER IDENTIFIER 310 | NUMERIC INPUT CODE 320 | BIOMETRIC DATA 330 | PHYSICAL MEASUREMENT DATA 340 |
|---|---|---|---|---|
| 301 | GF5892 | 12758 | 963248503682 | 382190553272 |
| 302 | JK4956 | 43267 | N/A | 913301448306 |

FIG. 5

SYSTEMS AND METHODS FOR DETERMINING AN OUTCOME OF A GAME ON A GAMING DEVICE BASED ON A FACTOR OTHER THAN A RANDOM NUMBER

The present Application is a continuation-in-part Application of commonly-owned U.S. patent application Ser. No. 09/992,147 to Walker et al., entitled METHOD AND APPARATUS FOR USING A PLAYER INPUT CODE TO AFFECT A GAMBLING OUTCOME and filed Nov. 19, 2001, now U.S. Pat. No. 6,511,376;

which is a continuation Application of U.S. patent application Ser. No. 09/439,307, filed Nov. 12, 1999 in the name of Walker et al., and which issued as U.S. Pat. No. 6,343,988 B1 on Feb. 2, 2002;

which in turn is a continuation application of U.S. patent application Ser. No. 08/833,034, filed Apr. 3, 1997 in the name of Walker et al, and which issued as U.S. Pat. No. 6,010,404 on Jan. 4, 2000.

The entirety of each of the above applications is incorporated by reference herein for all purposes.

RELATED APPLICATIONS

The present application is related to the following commonly-owned U.S. patent applications, each of which is incorporated by reference herein for all purposes:

U.S. application Ser. No. 10/007,874, which was filed on Nov. 12, 2001 in the name of Walker et al., now U.S. Pat. No. 6,648,762, and which is a Continuation Application of U.S. application Ser. No. 09/157,232, filed on Sep. 18, 1998 in the name of Walker et al. and issued on Dec. 11, 2001 as U.S. Pat. No. 6,328,648 B1;

U.S. application Ser. No. 09/521,875, which was filed Mar. 8, 2000 in the name of Walker et al., now U.S. Pat. No. 6,520,856, and which is a Continuation Application of U.S. application Ser. No. 09/052,291, filed on Mar. 31, 1998 in the name of Walker et al. and issued on May 30, 2000 as U.S. Pat. No. 6,068,552; and U.S. application Ser. No. 09/722,761, filed Nov. 27, 2001 in the name of Walker et al., now U.S. Pat. No. 6,561,902, which is a Continuation Application of U.S. application Ser. No. 09/000,628, filed Dec. 30, 1997 in the name of Walker et al. and issued on Jan. 1, 2001 as U.S. Pat. No. 6,174,235 B1.

BACKGROUND OF THE INVENTION

Many gamblers superstitiously believe that when they are feeling "lucky" they are sure to win. In casino games which allow players to add their personal input into the games, the players often believe that their "lucky" feelings are transferred to the objects of their input and that they can therefore somehow "control" the outcome of the game. For example, in the game of craps, many players believe that their good luck is transferred into the throw of the dice. They may therefore blow on the dice before throwing them or even throw them with a certain force or in a certain manner. In blackjack, players often believe that cutting the cards at a certain location in the deck has an influence on whether they will win or lose.

Of course such efforts to "control" the outcome of these games, unless cheating is employed, is purely illusory. However, it is this "illusion of control" that adds to player enjoyment, and in some cases is a primary attraction for these games. Although the "illusion of control" is present in table games such as blackjack and craps, it is conspicuously absent from modern electronic slot machines. In an electronically controlled slot machine, the player simply pushes a starter button and hopes for a winning result. The player does not typically believe that he has any influence over the outcome.

Since the 1970s, such electromechanical gaming devices have gained popularity in casinos. These electronic slot machines include reel-bearing slot machines, video poker machines, video blackjack and video keno games. The outcomes of these gaming devices are solely microprocessor controlled. For example, pulling the handle or pushing a button to start an electronic reel-bearing slot machine simply causes a random number to be obtained from a random number generator. Each random number that may be generated by the random number generator corresponds to a position of one or more reels. The resultant position of the one or more reels determines the amount of payout to the player. A random number is a pseudo random value generated via an algorithm. A popular algorithm used in slot machines is the Linear Feedback Shift Register (LFSR) mechanism, which is described in detail in the Ross Technologies Slots Report, published in 2002 by Ross Technologies and incorporated by reference herein for all purposes.

Because there is no way for the player to control the outcome of the machine, many players resort to searching for "lucky" machines. In a busy casino, however, there may be a limited number of machines available for selection. In video poker, although players are able to select which cards to hold and which cards to discard, the player has no control over what cards are originally dealt to him. Unlike blackjack, where a player can participate by cutting the cards, no such option exists for video poker players.

Accordingly, there is a need to incorporate a player benefit of the "illusion of control" into modem electronic gaming devices by providing a method and apparatus for utilizing a player input (e.g., numeric, biometric or physical) to determine an outcome of a game on a gaming device.

BRIEF DESCRIPTION OF THE DRAWINGS

FIG. 4 is a schematic view of an algorithm database;

FIG. 5 is a schematic view of a player database;

DETAILED DESCRIPTION

Figure 1:
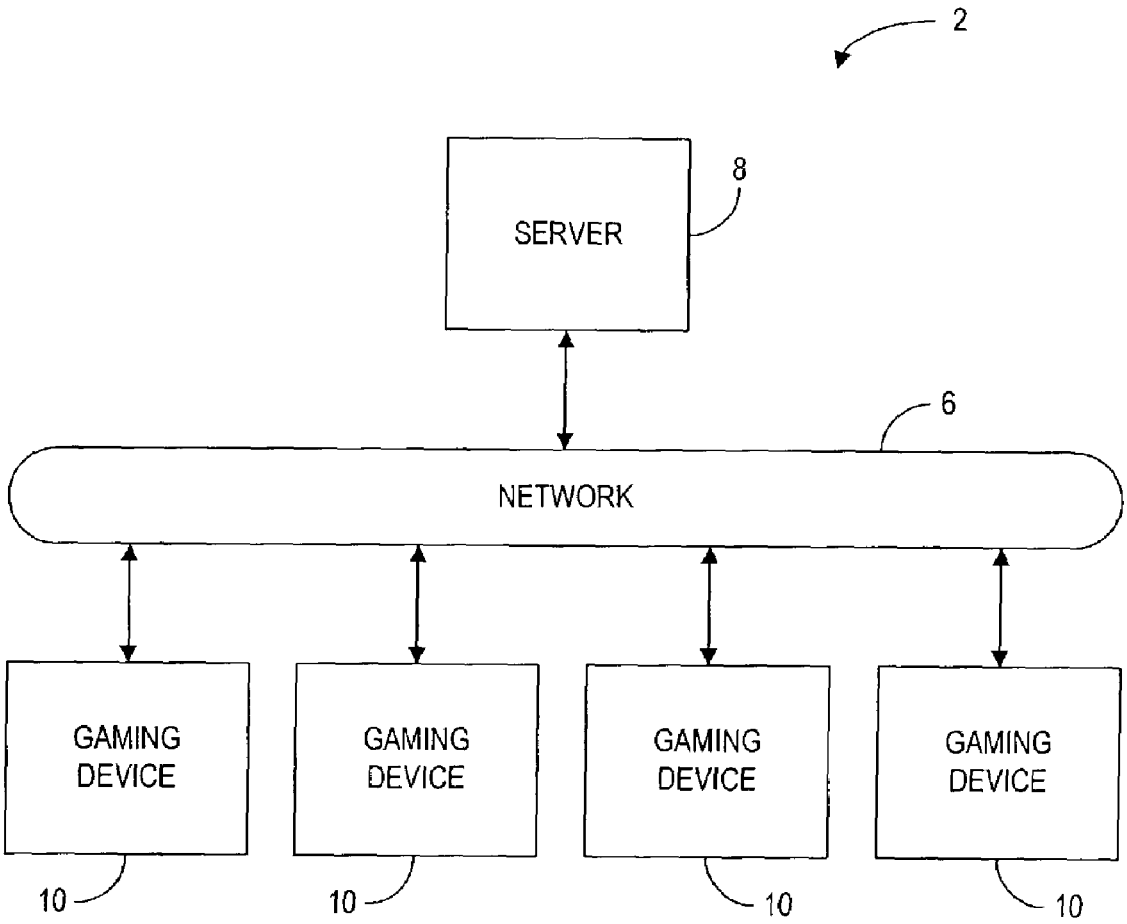
FIG. 1 is a schematic view of a system according to one or more embodiments of the present invention.

The present invention relates generally to a method and apparatus for operation of a gaming device, such as a slot machine and, more particularly, to the use of a player input to affect an outcome of the gaming device.

In accordance with one or more embodiments, a method and apparatus is provided for using a player input code (e.g., numeric, biometric or physical) b affect an outcome of a gaming device. The gaming device may comprise, for example, a means for receiving a player input code, means for receiving a random number, and a means for generating a numeric output as a function of the player input code and the random number.

In accordance with one or more embodiments, methods and apparatus are described for using a player input to determine a random number for use in determining an outcome of a gaming device. The player input may be utilized, for example, to select one of a plurality of available algorithms to use to determine a random number that corresponds to an outcome. In another example, the player input may be used as a seed in the algorithm for determining a random number that corresponds to an outcome. In yet another example, the player input may comprise a selection of one or more functions to be included in an algorithm that is used to determine a random number that corresponds to an outcome.

In accordance with one or more embodiments, a player of a gaming device may be allowed to select a random number from a plurality of random numbers generated by a random number generator of the gaming device. For example, visual representations, each corresponding to a respective random number, may be displayed to a player and the player may be allowed to select one of the visual representations. The random number corresponding to the selected visual representation may then be utilized to determine the corresponding outcome.

It should be noted that an outcome, as used herein unless expressly specified otherwise, comprises one or more indicia or other data (e.g., a set of reel symbols on a slot machine or a hand of cards on a video poker machine) that are utilized to inform a player of a benefit, if any, that is due to the player as a result of placing a wager on the gaming device. An example of a benefit that may be due to a player is a payout.

In one or more embodiments, a server for controlling a plurality of gaming devices (e.g., a slot server) is part of a system of the present invention. The server may comprise, for example, means for receiving a player identifier from a gaming device, a memory having a database with a first field representing the player identifier and a second field representing a player input code corresponding to the player identifier, means for accessing the player input code using the player identifier, and means for transmitting the player input from the database to the gaming device.

A method according to one or more embodiments of the present invention with respect to an electronic slot machine is now described for illustrative and exemplary purposes. The player inserts money into the slot machine and enters an input, e.g., a number, into a device attached externally to the slot machine. In other embodiments the player may enter the input into a component that is part of the slot machine. In yet other embodiments, the player may enter the input into another device (e.g., a kiosk, a personal computer, a portable computing device) that is not part of or attached to the slot machine but that is operative to communicate with the slot machine or another device (e.g., a slot server) that may in turn communicate with the slot machine.

Returning now to the description of the exemplary method, a processor of the slot machine receives the input and directs a random number generator to produce a random number. The processor retrieves a combination algorithm from an algorithm database and then applies the combination algorithm to the player number and the generated random number to form a combined value. The processor looks up the combined value in a probability table to determine resulting reel positions. The processor looks up the reel positions in a payout table to determine the amount of money won or lost by the player. If the player has won, the processor directs a hopper controller to release the appropriate number of coins or tokens into a payout tray. The book "Winning At Slot Machines" by Jim Regan (published in 1997 by Carol Publishing Group) describes in detail the operation of a conventional reeled slot machine, and how a random number may be utilized to determine an outcome and the payout corresponding to an outcome for a game. The entirety of this book is incorporated by reference herein for all purposes.

In one or more embodiments of the present invention, a slot network server interfaces with the gaming device and is used to communicate the player input code. Another illustrative and exemplary method that includes such a slot network server will now be described. The player inserts a player tracking card, which includes thereon the player's identifier, into the slot machine. The slot machine then prompts the player to enter his input code into the player input device. The slot machine transmits the data via a slot network to the slot network server, which stores the input code in a player database record corresponding to that player ID number. During each game play, the slot network server communicates the player input code to the slot machine.

Certain embodiments of the present invention will now be described in greater detail with reference to the drawings. Although some of the embodiments discussed herein are directed to electronic slot machines, it is to be understood that the present invention is equally applicable to other gaming devices, such as video poker machines, video blackjack machines, video roulette machines, video keno machines, video bingo machines, video lottery machines, pachinko machines, and the like.

Referring to FIG. 1, a system 2 according to the present invention is shown. In general, the system 2 comprises a plurality of gaming devices 10 and a server 8. Any number of gaming devices 10 may be in communication with server 8 (e.g., a slot network server). A variety of gaming devices (e.g, some slot machines, some video poker machines, some video keno machines) may be in communication with server 8. Each gaming device 10 is uniquely identified by a gaming device identifier and may communicate with the server 8 via network 6. Network 6 may comprise, for example, a conventional local area network. It is to be understood, however, that other arrangements in which the gaming devices 10 communicate with the server 8 are within the scope of the present invention, such as across a wireless network or Internet connection. It should also be understood that devices that are in communication with one another need not communicate continuously but may only communicate at regular or irregular intervals.

As will be described in greater detail below, in accordance with one or more embodiments, one or more of the gaming devices 10 may communicate player identifying information and player inputs to the server 8. The server 8 may, in one or more embodiments, store the information received from the one or more gaming devices 10. The server 8, when queried by one or more of the gaming devices 10, may communicate the information to the querying gaming device 10. With this arrangement, the player does not have to repeatedly provide a distinct input for each play, which can, under some circumstances, be time-consuming and frustrating. Accordingly, in one or more embodiments, the player can enter his input, e.g., a string of "lucky" numbers, into one gaming device 10 at one time and use those numbers for game play at that or any other gaming device 10. In one or more embodiments, an indication of a player input may be stored on a player tracking card or another portable medium that the player may insert or otherwise use to communicate the player input to a gaming device, rather than on the server 8. In one or more embodiments, the player input may be stored in a memory (e.g., a temporary memory such as RAM) of the gaming device.

Figure 2:
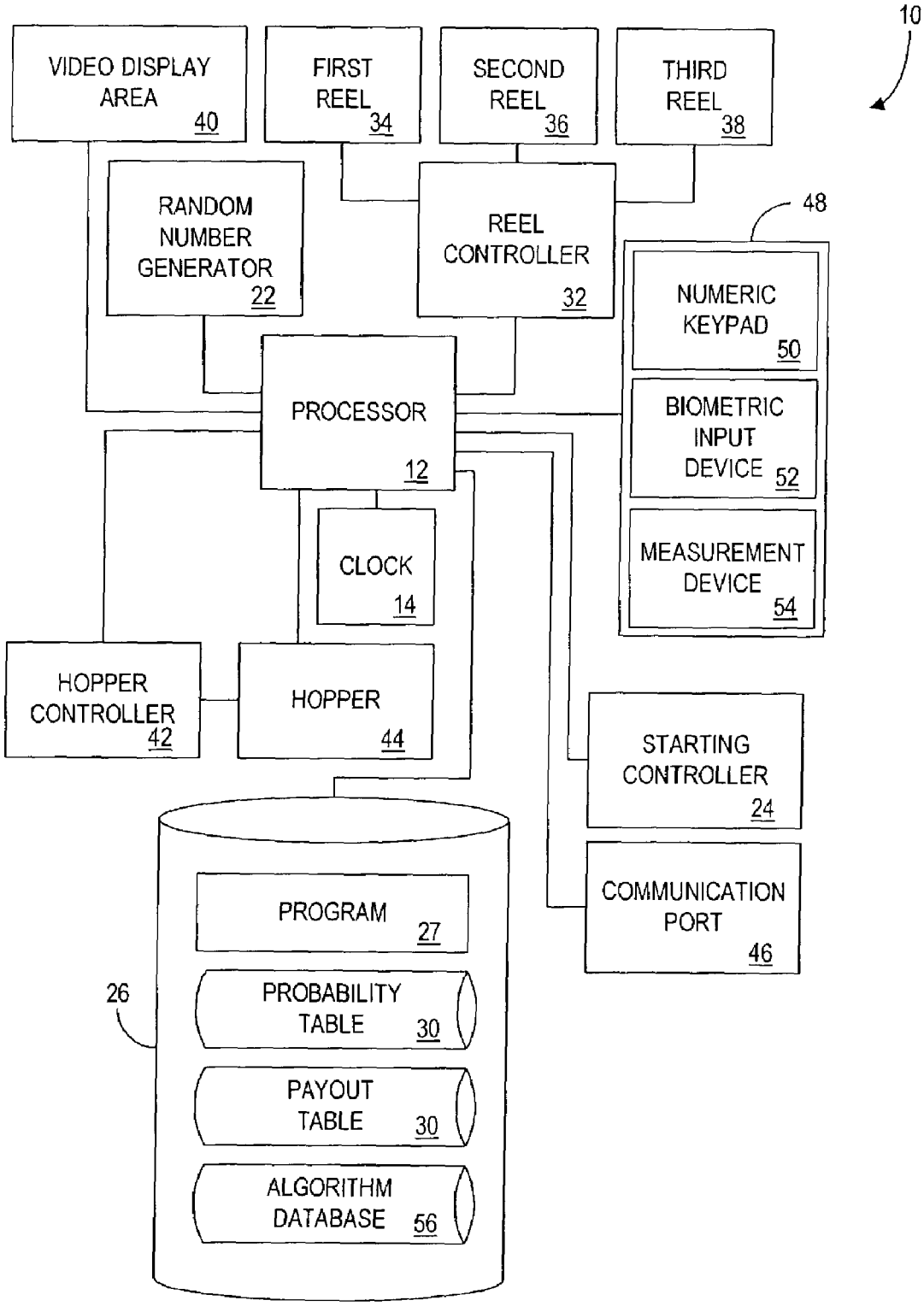
FIG. 2 is a schematic view of the slot machine of FIG. 1.

With reference now to FIG. 2, a gaming device 10, representative of one or more of the gaming devices of system 2, according to one or more embodiments of the present invention will now be described in greater detail. For illustrative purposes only, the gaming device of FIG. 2 is embodied as a reeled slot machine. The gaming device 10 comprises a processor 12 that controls the operations of the gaming device 10. The processor 12 is operative to communicate with a clock 14, a Random Number Generator ("RNG") 22, a starting controller 24, a memory 26, a reel controller 32 (connected to reels 34, 36 and 38), a video display area 40, a hopper controller 42, a communication port 46, and a player input device 48. The processor 12 may be operative to communicate with any number of additional components.

The communication port 46 may facilitate communications between the gaming device 10 and another device. For example, the gaming device 10 may communicate with the server 8 (e.g., via the slot network 6), with a kiosk used to receive player inputs, with a customer service computer, and/or with a remote device of a user (e.g., a wristwatch, cellular telephone, personal digital assistant (PDA)) operable to communicate player inputs to the gaming device 10.

The player input device 48 is shown as a keypad 50, a biometric input device 52 or a measurement device 54. However, the player input device 48 may be any device known in the art operative to receive a player input (e.g., a touchscreen), or may be any combination of the above. For example, the player input may comprise brainwaves in accordance with one or more embodiments. In such embodiments, the player input device may comprise a device capable of detecting the brainwaves of a player. One example of such a device is the control-signal input device described in U.S. Pat. No. 5,470,081 to Sato et al., which is hereby incorporated by reference for all appropriate purposes.

Many other types of player inputs derived from the player's biological characteristics are possible. In one or more embodiments the skin conductivity of a player may be measured and utilized as a player input. In one or more embodiments, a sample of a player's DNA may be obtained and utilized as a player input. In one or more embodiments, a player's heat signature may be obtained and utilized as a player input. In one or more embodiments the color of a player's hair, weight, or voice volume or other characteristic may be determined and used as a player input.

In one or more embodiments, a player input may comprise a unique magnetic signature of a magnetic stripe card such as a credit, debit, or charge card or a player tracking card issued by a casino. Each such card that includes a magnetic stripe has a unique magnetic signature that is determined based on magnetic background noise due to the random arrangements of magnetic particles in the background of each stripe. Such random arrangements of magnetic particles constitute a unique signature analogous to a biometric such as a person's fingerprint. Thus, in one or more embodiments the player input device 48 may comprise a magnetic stripe reader capable of detecting such a unique signature of a magnetic stripe. For example, the player input device may comprise The Cube™, a magnetic stripe card accepter marketed jointly by the XTec™ and SEMTEK™ companies. Thus, in order to provide a player input, a player may swipe a magnetic stripe card through such a player input device. The magnetic signature of the card may then be used (after being converted to a proper format, as necessary) to determine a random number in accordance with one or more embodiments of the present invention.

The keypad 50 allows a player to key in one or more numbers or other characters as an input. An input can alternatively be obtained by, although not limited to, a touch screen, a casino player tracking card, player selection from a set of characters provided by the gaming device 10, or preferred player numbers stored at either the slot network server 8 or gaming device 10 and used as defaults, as will be discussed in more detail below.

The biometric input device 52 may be operable to read a player's personal physical characteristics. Examples of such physical characteristics include, but are not limited to, the player's fingerprint, hand geometry, heart rate, body temperature, iris pattern, retinal pattern, voice, signature, or thermal image. During the reading process, software is used to translate the player's physical characteristics into numeric codes, digitizing each biometric feature. The software used for translation may be located either internally within the biometric input device 52 or stored in memory 26. In one or more embodiments of the present invention, the biometric input device 52 is operative to convert each measured characteristic into a numeric input code or other proper form that is usable for determining an outcome, as appropriate.

The measurement device 54 measures physical motions of the player. For example, the measurement device 54 may measure the speed and/or direction of a player's hand waved across or near a receptor of the measurement device 54, the force the player applies in the twisting and turning of knobs and/or actuation of buttons of the gaming device, and/or the pressure the player applies against an object (e.g., a touchscreen or other surface). As with the biometric input device 52, in one or more embodiment of the present invention the measurement device 54 is operative to convert a measurement into a numeric input code or other proper form, as appropriate.

The gaming device 10 comprises a processor 12, such as one or more Intel® Pentium® processors. The processor 12 is in communication with a memory 26. The memory 26 may comprise an appropriate combination of magnetic, optical and/or semiconductor memory, and may include, for example, Random Access Memory (RAM), Read-Only Memory (ROM), a compact disc and/or a hard disk. The processor 12 and the memory 26 may each be, for example: (i) located entirely within a single computer or other device; or (ii) connected to each other by a remote communication medium, such as a serial port cable, telephone line or radio frequency transceiver. In one embodiment, the gaming device may comprise one or more devices that are connected to a remote server computer for maintaining databases.

The memory 26 stores a program 27 for controlling the processor 12. The processor 12 performs instructions of the program 27, and thereby operates in accordance with the present invention, and particularly in accordance with the methods described in detail herein. The program 27 may be stored in a compressed, uncompiled and/or encrypted format. The program 27 furthermore includes program elements that may be necessary, such as an operating system, a database management system and "device drivers" for allowing the processor 12 to interface with computer peripheral devices. Appropriate program elements are known to those skilled in the art, and need not be described in detail herein.

According to an embodiment of the present invention, the instructions of the program 27 may be read into a main memory from another computer-readable medium, such from a ROM to RAM. Execution of sequences of the instructions in program 27 causes processor 12 to perform the process steps described herein. In alternate embodiments, hard-wired circuitry may be used in place of, or in combination with, software instructions for implementation of the processes of the present invention. Thus, embodiments of the present invention are not limited to any specific combination of hardware and software. The memory 26 also stores a plurality of databases. For example, a probability table 28, a payout table 30, and an algorithm database 56 are illustrated as being stored in memory 26. Of course any number of databases may be stored in memory 26. In alternate embodiments, such databases may be stored in a device distinct from gaming device 10 and accessible by gaming device 10.

Although the reels 134, 136, and 138 are illustrated as being mechanical in nature and controlled by reel controller 32, in alternate embodiments the invention may be practiced using electronic images of reels displayed on a display area of the gaming device 10. For example, the video display area 40 may be used to display images of reels and simulations of the spinning of reels. The video display area 40 may also be utilized to display other information, such as messages directed to a player or visual representations of random numbers, algorithms, and/or functions for algorithms (as will be explained in more detail below). Such information may be displayed in addition to or in lieu of displaying images of reels on the video display area 40.

The probability table 28 that may be stored in memory 26 may include a plurality of records or entries, each defining reel positions that correspond to a numeric value that may be generated by a random number generator or be obtained as a result of combining a player input with a random number or other input. The probability table 28 further defines fields for each of the records such as, for example, a first field representing a value or range of values and a second field representing the corresponding output or position for each reel 34, 36 and 38. For example, the first field may contain the range of {1 to 10,000}, and the second field may contain the resultant reel positions as "Cherry-Cherry-Bar". For example, if a value that results from inputting a random number and a player input as variable values for an algorithm is 523, reel 134 will spin to a "Cherry," the reel 136 will spin to a "Cherry," and the reel 138 will spin to a "Bar." In embodiments wherein an outcome is displayed on an electronic display screen, the symbols "cherry-cherry-bar" may be displayed on the screen instead.

As will be discussed in more detail below, the second field containing resulting reel positions could consist of only a single reel position. For example, for a range of {1 to 10,000}, the resultant reel position is {Cherry}; for a range of {10,001 to 20,000}, the resultant reel position is {Bell}; and for a range of {20,001 to 30,000}, the resulting reel position is {Bar}. Thus, each reel position would have to be determined individually as opposed to by group by independently calculating a combined value for each reel. For example, using the fields described above, in a game play consisting of three independently calculated combined values of {25,243; 567; 11,899}, the resulting positions of reels 34, 36 and 38, respectively, are {Bar, Cherry, Bell}.

The payout table 30 that may be stored in memory 26 may include a plurality of records, each record defining an amount of money won or lost by the player for each resultant set of reel positions (i.e., outcome). The payout table may include fields for each of the records. The fields may comprise, for example, a first field representing the resultant reel positions, and a second field representing a corresponding payout. For example, for resultant reel positions of "Cherry-Cherry-Bell", the corresponding payout may be "5 coins" or "5 credits".

Also in communication with the processor 12 may be a player tracking device (not shown). The player tracking device may comprise a conventional card reader for reading player identification information such as may be stored on a player tracking card or associated with a player identifier indicated by a player tracking card. As used herein, the term "player identifying information" denotes any information or compilation of information that uniquely identifies a player. In one or more embodiments, the player identifying information may be a player identifier. Although not so limited, a player tracking card may store the player identifier on a magnetic strip located thereon. Commercially available player card tracking devices include, for example, the Mastercom device available from Bally Manufacturing. (See, for example, U.S. Pat. No. 5,429,361 to Raven et al.). The utilization of a player identifier number by the system 2 will be discussed in greater detail below.

In one or more embodiments, a gaming device 10 may also include a button or other means via which a player may signal a request to reuse a player input previously provided. For example, a player may provide a player input for a game of the gaming device and wish to reuse the same input for a subsequent game. Rather than re-entering the player input, the player may be able to indicate a desire to do this via a predetermined means (e.g., actuating a button, twisting a knob, actuating a key on a keyboard, speaking into a microphone, touching a designated area of a touchscreen, etc.).

An exemplary play of a game on a conventional gaming device will now be described. A player may initiate play on a gaming device 10 by inserting coins into a coin acceptor on the gaming device 10, by selecting the use of stored electronic credit, or by providing a financial account identifier (e.g., a credit or debit card identifier or a casino account identifier). A detector determines the number of coins that were fed into the gaming device 10 or amount of other form of payment provided and establishes the appropriate electronic credit. The player may then select the amount of electronic credit he wishes to bet, and may activate the gaming device via the starting controller 24 by, for example, either pressing a "SPIN" button or pulling a handle. Under control of the program 27, the processor 12 may obtain a random number generated by the RNG 22. The RNG 22, as is typical of some random number generators, may generate thousands of random numbers per second. Thus, the random number obtained for the game currently being initiated may be, for example, the random number generated at substantially the time the player pressed the "SPIN" button or began pulling the handle. The processor 12 refers to the probability table 28 and finds the reel positions that correspond to the generated random number. Based on the identified reel positions, the processor 12 locates the appropriate payout in the payout table 30. The processor 12 directs the reel controller 32 to spin (via a motor) the reels 134, 136 and 138 for a short period of time and to then stop them at a point when they display the appropriate symbols. If the player wins, the gaming device may store the credits in memory (e.g., RAM) and display the credits in the video display area 40 or another display area (e.g., a display of a credit meter). When the player requests to cash out by pushing a button on the gaming device 10, the processor 12 checks its memory to see if the player has any credit, and if so, signals the hopper controller 42 to release an appropriate number of coins from the hopper 44 into a payout tray (not shown).

Figure 3:
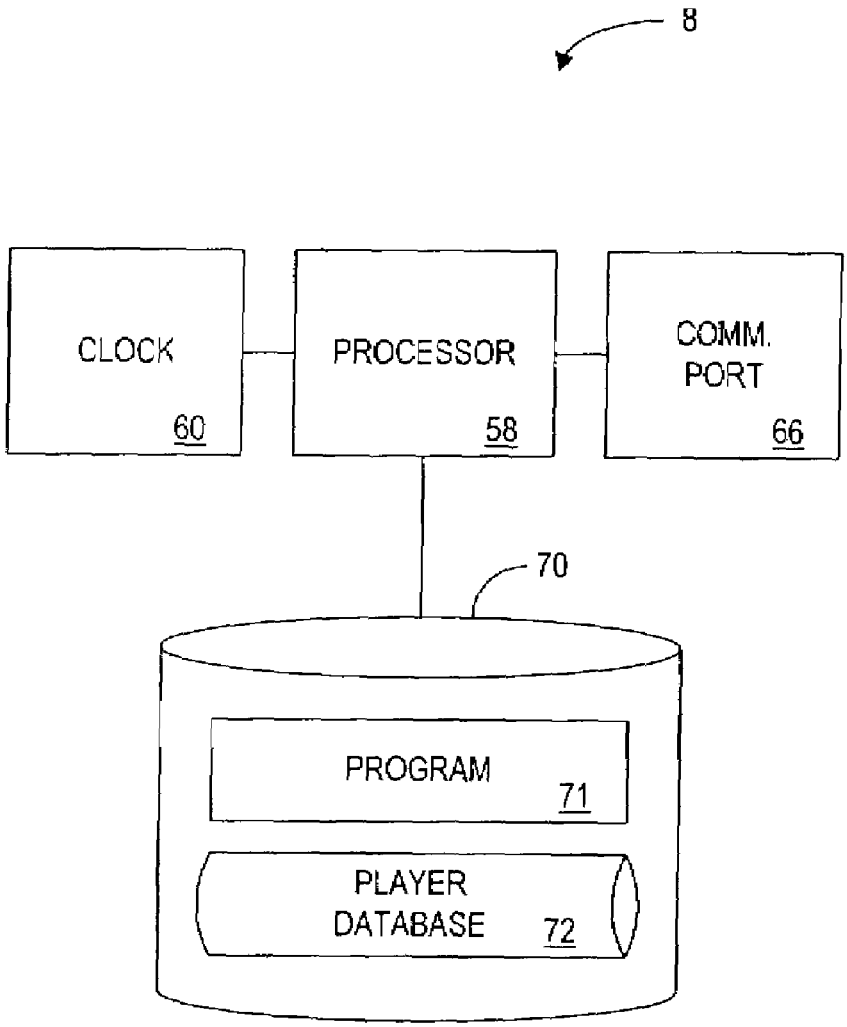
FIG. 3 is a schematic view of the slot network server of FIG. 1.

Referring now to FIG. 3, an exemplary embodiment of the server 8 of system 2 (FIG. 1) will now be described in greater detail. As with the gaming device 10 of FIG. 2, the server 8 comprises a processor (processor 58). The processor 58 may comprise one or more Pentium™ microprocessors or an equivalent thereof. The processor 58 is in communication with a clock 60, a communications port 66, and a memory 70. The communications port 66 may allow the server 8 to communicate with one or more gaming devices 10 and/or one or more other devices. The memory 70 stores a program 71 and one or more databases. Memory 70 is illustrated as storing a player database 72, which will be described in more detail below.

The memory 70 may comprise an appropriate combination of magnetic, optical and/or semiconductor memory, and may include, for example, Random Access Memory (RAM), Read-Only Memory (ROM), a compact disc and/or a hard disk. The processor 58 and the memory 70 may each be, for example: (i) located entirely within a single computer or other device; or (ii) connected to each other by a remote communication medium, such as a serial port cable, telephone line or radio frequency transceiver. In one embodiment, the server 8 may comprise one or more devices that are connected to another remote server computer for maintaining databases.

As noted, the memory 70 stores a program 71 for controlling the processor 58. The processor 58 performs instructions of the program 70, and thereby operates in accordance with the present invention, and particularly in accordance with the methods described in detail herein. The program 70 may be stored in a compressed, uncompiled and/or encrypted format. The program 27 furthermore includes program elements that may be necessary, such as an operating system, a database management system and "device drivers" for allowing the processor 12 to interface with computer peripheral devices. Appropriate program elements are known to those skilled in the art, and need not be described in detail herein.

According to an embodiment of the present invention, the instructions of the program 70 may be read into a main memory from another computer-readable medium, such from a ROM to RAM. Execution of sequences of the instructions in program 70 causes processor 58 to perform the process steps described herein. In alternate embodiments, hard-wired circuitry may be used in place of, or in combination with, software instructions for implementation of the processes of the present invention. Thus, embodiments of the present invention are not limited to any specific combination of hardware and software.

Databases

Referring now to FIG. 4, a tabular representation 200 of all or a portion of the algorithm database 56 (FIG. 2), includes a number of records or entries 210 and 215. Each of the records of table 200 defines an algorithm that may be used to generate a random number or a value reflecting a combination of a random number generated by a random number generator and a player input. Those skilled in the art will recognize that the algorithm database may include any number of entries. The tabular representation 200 also defines fields for each of the entries or records. The fields specify: (i) an algorithm identifier 210; (ii) required input(s) 220; and (iii) algorithm 230. In embodiments where more than one algorithm is stored in the algorithm database and available for use by a gaming device 10, the gaming device 10 may select one of the algorithms for use (e.g., on a random basis or based on a predetermined rule). In some embodiments, input from a player may be utilized to select which of the algorithms to use.

Examples of representative algorithms requiring inputs of at least a player input code ("PIC") and a random number generated by the slot machine 10 ("RN"), and optionally the current time, in seconds, as measured by the clock 14 ("TIME"), and/or a constant ("K") are as follows:

$$\text{OUTPUT}=[PIC\times RN]^2\times\text{TIME} \qquad \text{Algorithm \#1:}$$

$$\text{OUTPUT}=[PIC+RN+K]^2\times\text{TIME} \qquad \text{Algorithm \#2:}$$

With respect to the algorithm with its identification number as "1", i.e., Algorithm #1, for purposes of illustration, field 210 would contain {1}, field 220 would contain {PIC, RN, TIME}, and field 230 would contain $\{[\text{PIC}\times\text{RN}]^2\times\text{TIME}\}$.

Referring now to FIG. 5, an exemplary tabular representation 300 of the player database 72 includes a plurality of records 301 and 302, each defining data associated with a player. Those skilled in the art will recognize that the player database may include any number of entries. The tabular representation 300 also defines fields for each of the entries or records. The fields specify: (i) a player identifier 310; (ii) a preferred numeric input code 320 (e.g., representing a set of numbers that a player has entered via numeric keypad 50); (iii) biometric data 330, comprising a set of characters representing a biometric measurement associated with the player (e.g., as may be obtained via biometric input device 52); and (iv) measurement data 340, comprising a set of characters representing a measurement (e.g., as may have been taken via measurement device 54). Although the data in fields 330 and 340 are illustrated in the form of a set of characters, such data may be stored in other formats. For example, an image of a retinal scan may be stored as a file (e.g., a jpeg file) and converted to another format as necessary (e.g., as a gaming device needs to use the data to determine an outcome for a game). The player database may be used, for example, to access one or more player inputs for determining an outcome of a game on a gaming device based on a player identifier provided by the player and to store such player inputs in association with a player identifier when they are obtained or when a player indicates a desire to store them for future use.

It is to be understood that not all of the fields illustrated in tabular representation 200 and tabular representation 300 are necessary for operation of the present invention. Furthermore, other fields may be included in these databases and additional databases or alternative data structures may be used. For example, the tabular representation 300 of the player database may include contact information associated with the player (e.g., postal address, electronic mail address, telephone number), data representing the gambling history of the player (e.g., number of hours played or total amount of wagers placed over a predetermined period of time) may also be stored in the player database.

Processes

Figure 6A:
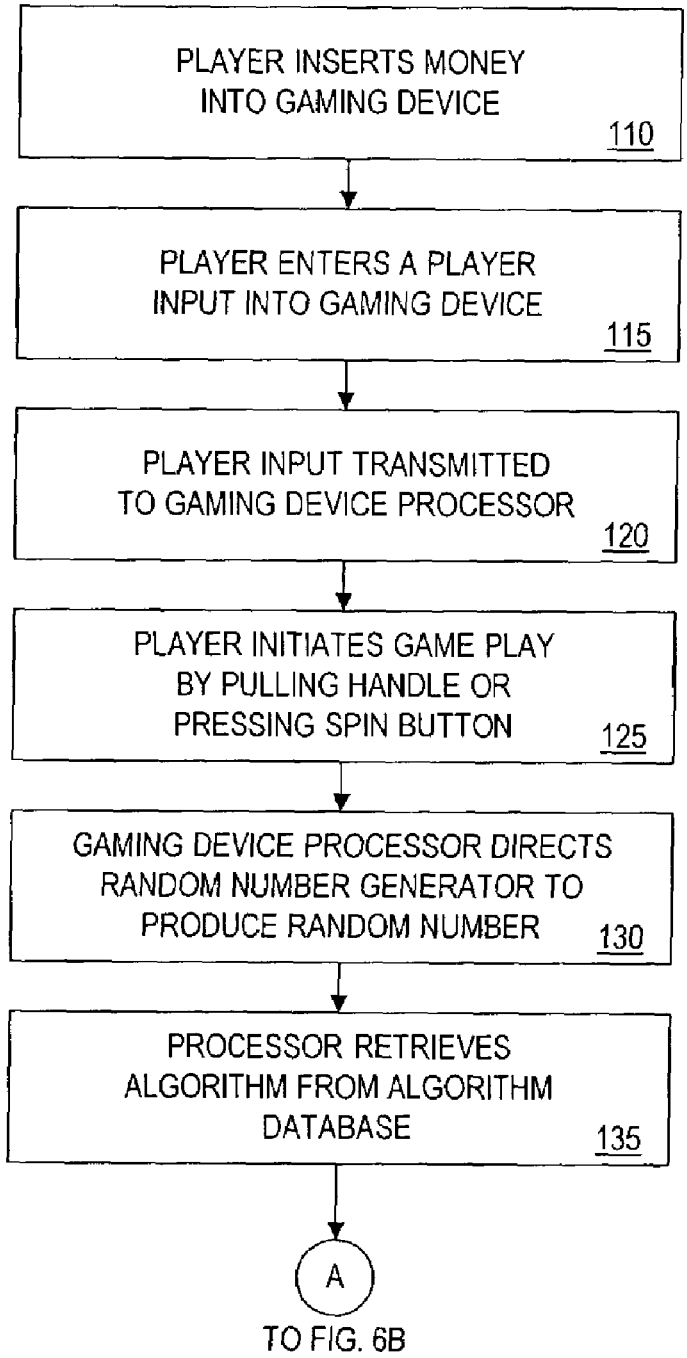
FIGS. 6A and 6B are flow diagrams depicting a process of playing a gaming device, such as a slot machine, without a slot network server.
Figure 6B:
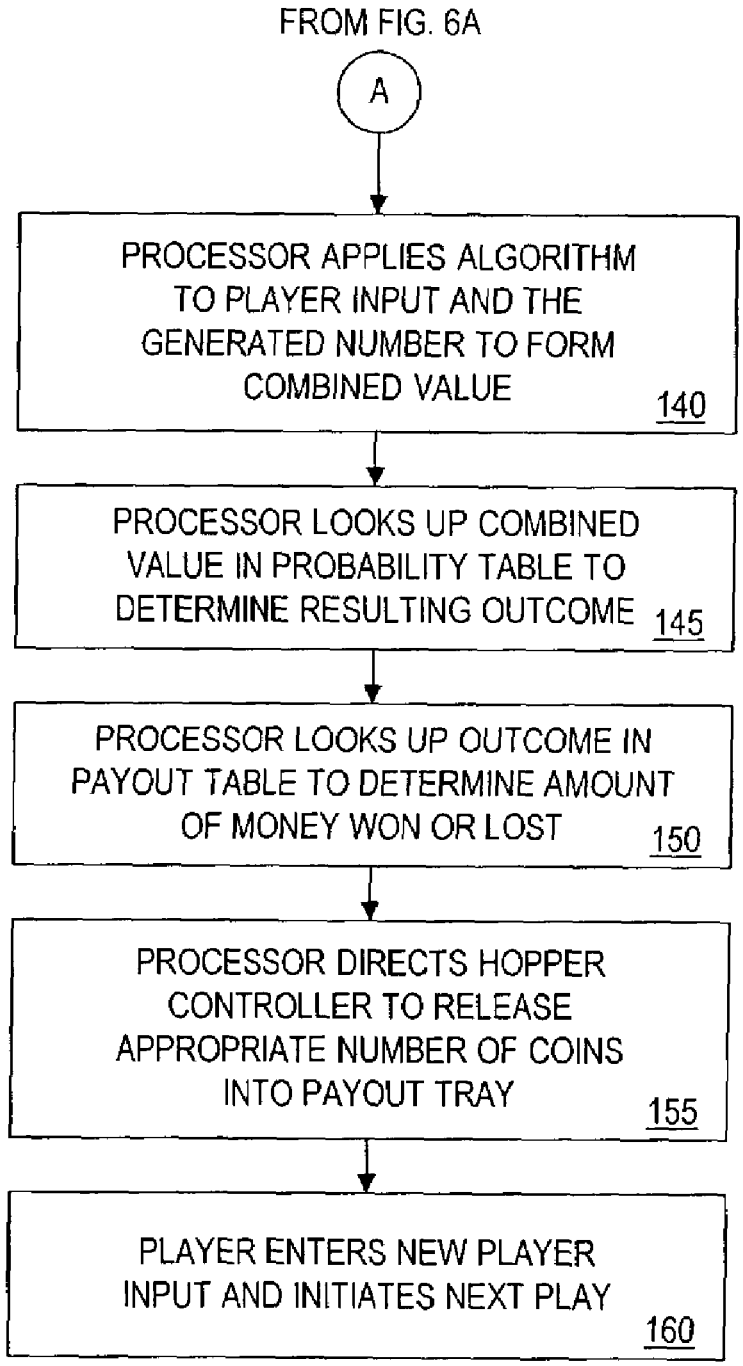

Having thus described the components of some embodiments of the present invention, the operation of the gaming device 10 (without the use of server 8) will now be described with reference to FIGS. 6A and 6B. FIGS. 6A and 6B comprise an exemplary process for operation of a gaming device 10, in accordance with one or more embodiments of the present invention.

As shown in step 110, a player may start the operation of a gaming device 10 by inserting money into the gaming device 10. After the player selects the amount of credit he wishes to bet, the processor 12 directs the player input device 48 to prompt the player to enter an input.

In step 115, the player enters his input into the player input device 48. Depending on which type of player input device 48 is utilized at the particular gaming device 10, the input may be either numeric, biometric or physical. For numeric input, the player enters a number into the numeric keypad 50 of the gaming device 10. For biometric input, the player input device 48 is the biometric input device 52 which reads one or a combination of the player's fingerprint, hand geometry, heart rate, body temperature, iris pattern, retinal pattern, voice, signature, or thermal image. For a physical input, the player input device 48 is the measurement device 54. In accordance with one or more embodiments of the present embodiment, if a biometric or physical input is taken, the device 48 may convert the biometric or physical input into a numeric input code or other format as appropriate.

In step 120, the player input code is transmitted to the processor 12 of the gaming device 10. The processor 12 stores the player input code in memory (e.g., RAM), and may also enable the starting controller 24.

In step 125, the player initiates game play by pulling the handle or pressing the "SPIN" button of the gaming device 10, thereby activating the starting controller 24. The starting controller 24 sends a signal to the processor 12 that play has been initiated.

In step 130, the processor 12 of the gaming device 10 directs the RNG 22 to produce a random number within a predetermined range. The random number is stored in memory (e.g., RAM).

In step 135, the processor 12 retrieves an algorithm from the algorithm database 56. In one embodiment, there may only be one algorithm in the database, which may always be selected by the processor 12 for every game play and require only the player input code and the gaming device generated random number. In step 140, the processor 12 applies the algorithm to the player input code and the generated random number to form a combined value. The processor 12 locates the combined value in the probability table 28 to determine the resulting positions of reels 34, 36 and 38 (step 145) or to otherwise determined the outcome to be displayed in a display area of the gaming device. The processor 12 may direct the reel controller 32, if the gaming device is a mechanical reel slot machine, to adjust the reels 34, 36 and 38 to their appropriate positions.

In step 150, the processor 12 looks up the reel positions or determined outcome in the payout table 30 to determine the amount of money won or lost by the player. If the player has won, the processor 12 directs the hopper controller 42 to release an appropriate number of coins from the hopper 44 into the payout tray (step 155). Alternatively, the processor may increase a credit meter balance by the appropriate number of credits.

In step 160, the player enters a new number into the numeric keypad 50 or otherwise provides a new player input and initiates the next play of the gaming device 10. Alternatively, the player may indicate that the same input code provided for the earlier game should be used for the next game as well (e.g., by actuating a button designated for such an indication or selecting an area of a touchscreen designated for such an indication, as discussed above).

In one or more other embodiments of the present invention, the server 8 is used to provide the player input. For example, rather than providing a player input to the gaming device, the player may provide a player identifier that may be used to retrieve a previously provided player input that is stored in association with the player identifier (e.g., in the player database of server 8). For example, the player may insert his player tracking card, which contains the player's player identifier, into a player tracking device of the gaming device 10. The gaming device 10 may transmit the player identifier via the network 6 to the server 8. The server 8 may, in response to receiving the player identifier from the gaming device, retrieve a record of the player database 72 based on the player identifier in field 330 of the player database 72. In one embodiment, the server 8 may communicate a stored player input associated with the player identifier to the gaming device 10 for each game initiated by the player. Alternatively, the server 8 may provide the stored player input 8 once to the gaming device in response to such a request and the gaming device 10 may temporarily store the player input in memory and continue to use it for each game play until the player indicates otherwise and/or until the player removes his player tracking card from the player tracking device of the gaming device 10. In one or more embodiments, one or more player inputs may be stored directly on a player tracking card in addition to or in lieu of being stored on server 8.

In one or more embodiments, there may be multiple player inputs stored in the player database 72, e.g., a plurality of sets of the player's "lucky" numbers. In such embodiments the server 8 and/or the gaming device 10 may be programmed to cycle through the inputs for each game play, to randomly select one of the stored player inputs for use, and/or to prompt the player to select one of the stored player inputs for use.

One of the advantages of storing one or more player inputs in a database of server 8 or on a player tracking card is that it allows a player to quickly reuse previously provided inputs as the player moves from one gaming device to another. Additionally, if time is required to convert a player input to an appropriate format (e.g., it may take a few seconds to convert an image of a fingerprint to a numeric input form required for an exemplary algorithm), it may be more efficient to perform this conversion once when the player first provides the player input, rather than performing the conversion for each game, gaming session, or gaming device and/or requiring the player to re-enter the input for each game, gaming session, or gaming device.

In one or more embodiments of the present invention, the processor 12 may obtain three distinct random numbers from RNG 22. Each random number generated is used as input to be used independently in a combination algorithm to determine the individual position of each reel 34, 36 and 38. In such embodiments, the probability table 28 is of the type described above wherein the second field representing the resultant reel position is a single symbol.

In one or more embodiments of the present invention, an algorithm is selected from the algorithm database 56 by the processor 12 directing the RNG 22 to select a random number from 1 to N, N being the total number of algorithms in the algorithm database 56. The number selected is the algorithm identifier of field 210. The processor 12 may retrieve the corresponding algorithm in field 230, and determine the input(s) that are required other than the player input code or the generated random number in field 220. The processor 12 may obtain the requisite inputs, such as by reading the current time measured by the clock in seconds, and then apply the algorithm to obtain the combined value.

In the one or more embodiments wherein each reel position is determined independently, the processor 12 can be programmed to either use one algorithm for determining each reel position or select the random number from 1 to N to select a different algorithm for each reel 134, 136 and 138.

In one or more embodiments of the present invention, the processor 12 may execute a program stored in memory 26 to convert the biometric or physical input into a numeric input code or other required format, as appropriate.

In one or more embodiments of the present invention, the player input device 48 is not limited to a single input, i.e., multiple inputs can be used to determine the output of one game play. For example, a numeric input can be used determine the output of the first reel, a biometric characteristic can be used to determine the output of the second reel, and a physical measurement can be used to determine the output of the third reel. Alternatively, two or more of the same type of player input (e.g., a biometric characteristic) can be combined to form one single input code.

It should be noted that, in one or more embodiments, a player input may comprise a selection, indication, or data other than a set of characters or an input that is converted to a set of characters. For example, in one or more embodiments a player input may comprise a selection of which algorithm, from a plurality of available algorithms, is to be used to determine a random number for one or more games played on a gaming device. In another example, in one or more embodiments a player input may comprise a selection of one or more functions and/or variables to be included in an algorithm that is to be used to determine a random number for one or more games being played on a gaming device. In yet another example, in one or more embodiments a player input may comprise a selection of a representation of a random number, from a plurality of representations, each representation representing a random number generated by a random number of a gaming device.

Figure 7:
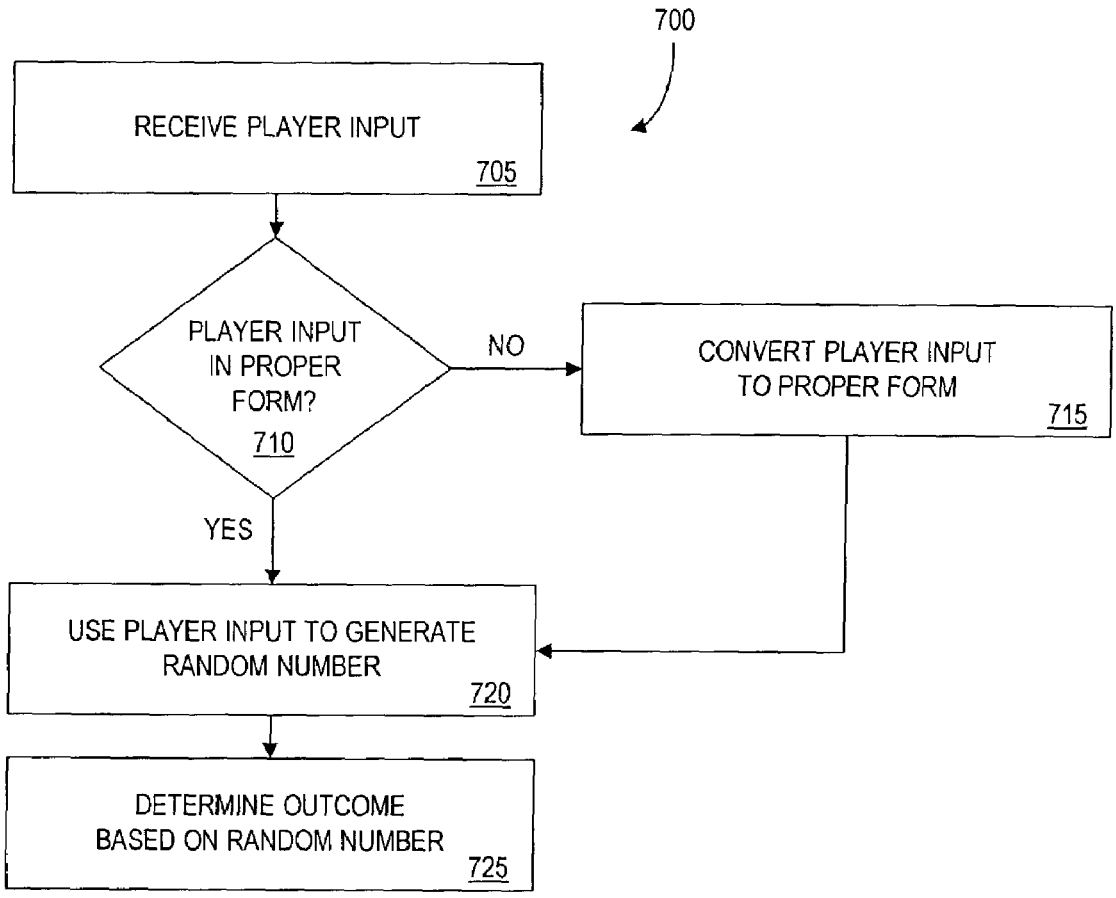
FIG. 7 is a flow chart depicting a process consistent with one or more embodiments of the present invention.

Referring now to FIG. 7, a flowchart illustrates the steps of a process 700 consistent with one or more embodiments of the present invention. In accordance with one or more embodiments of the present invention, a player input may be used to determine a random number (rather than be combined with a random number that is determined without the use of the player input, as described above). For example, the player input may be used as the seed or other variable in an algorithm used to determine a random number, which in turn is used to determine a corresponding outcome. Process 700 is depicted as being performed by a gaming device 10. In other embodiments, some or all of the steps of process 700 may be performed by another device (e.g., server 8).

In step 705, the player input is received. The player input may be received, as described above, from the server 8 or via player input device 48. In step 710 it is determined whether the received player input is in a proper format (e.g., the input comprises the appropriate number and type of characters required for use in an algorithm). If the player input is not in a proper format, the process 700 continues to step 715, where the player input is converted into the proper format. After the step of converting, the process 700 continues to step 720. If, in step 710, it has been determined that the received player input is in proper format, the process also continues to step 720.

In step 720 the player input is used to generate a random number. For example, the player input may be inserted as a seed or other variable into the algorithm being used to determined the random number.

In one or more embodiments, the player input may comprise a selection of which of a plurality of available algorithms to use. In such embodiments, the step 720 may comprise retrieving the algorithm that was selected by the player and utilizing it to generate the random number.

In one or more embodiments, the player input may comprise a selection of one or more functions to be included in an algorithm to be used to determine the random number for a game being played on the gaming device 10. In such embodiments, the step 720 may comprise formulating or selecting an algorithm based on the functions selected by the player and utilizing the algorithm to determine a random number.

In step 725, an outcome that corresponds to the random number generated based on the player input is determined. For example, a probability table may be accessed and a set of indicia comprising an outcome that corresponds to the random number generated in step 720 in an entry of the table may be selected for output.

Figure 8A:
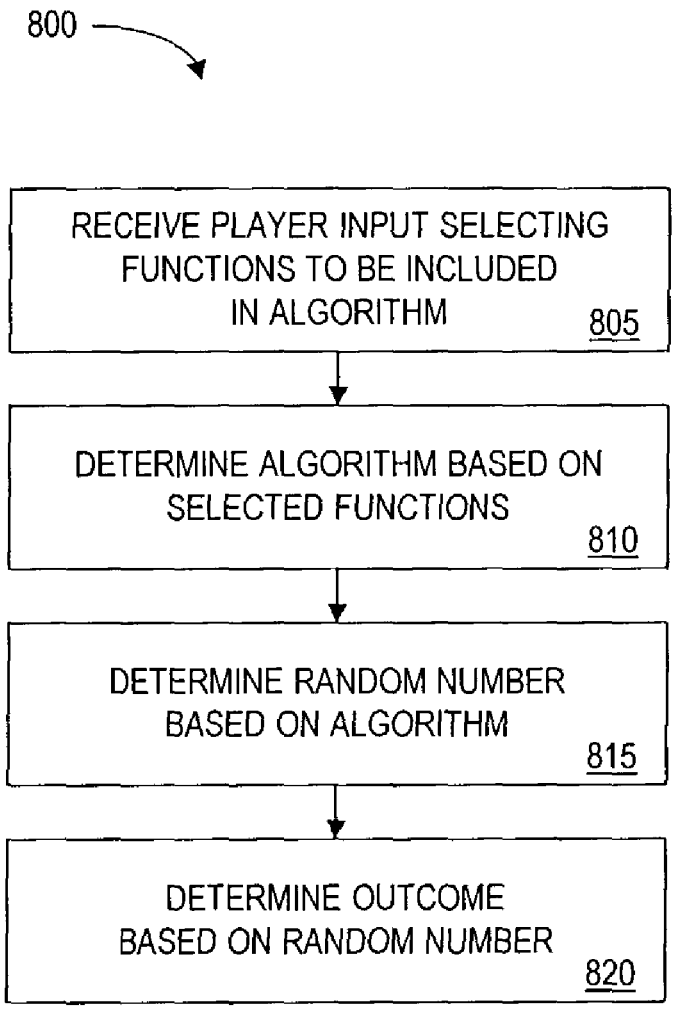
FIG. 8A is a flow chart depicting a process consistent with one or more embodiments of the present invention.

Referring now to FIG. 8A, a flowchart illustrates the steps of a process 800 consistent with one or more embodiments of the present invention. Process 800 may be utilized in the one or more embodiments described with reference to step 720 of process 700 (FIG. 7), wherein a player input comprises a selection of one or more functions to be included in an algorithm to be used to determine a random number for at least one game of a gaming device.

In step 805, a player input that comprises a selection of one or more functions to be included in an algorithm is received. Such an input may be received, for example, from the server 8 (e.g., based on a selection of one or more functions previously provided by a player) or via the player input device 48. For example, a player may directly select one or more functions available for inclusion in an algorithm to be used to generate a random number for a game of the gaming device. The player may indicate such a selection by, for example, speaking into a microphone, actuating a button that corresponds to an available function displayed (e.g., on a display of the gaming device), selecting a representation of a function from a touchscreen area of the gaming device, or typing in an identifier corresponding to a function via a keypad of the gaming device.

In one or more embodiments, a player input other than a direct selection of one or more available functions is received in step 805. For example, a player input such as a biometric, physical, or numeric input may be received. This player input may then be used by the gaming device to select one or more functions. For example, each available function may be associated with a respective range of numbers. The player input comprising a biometric, physical, or numeric input may be received and converted into a number that comprises the appropriate number of decimal places such that it falls within one of the ranges of numbers corresponding to one of the functions. The function that corresponds to the range within with the player input falls may then be selected for inclusion in an algorithm.

Figure 8B:
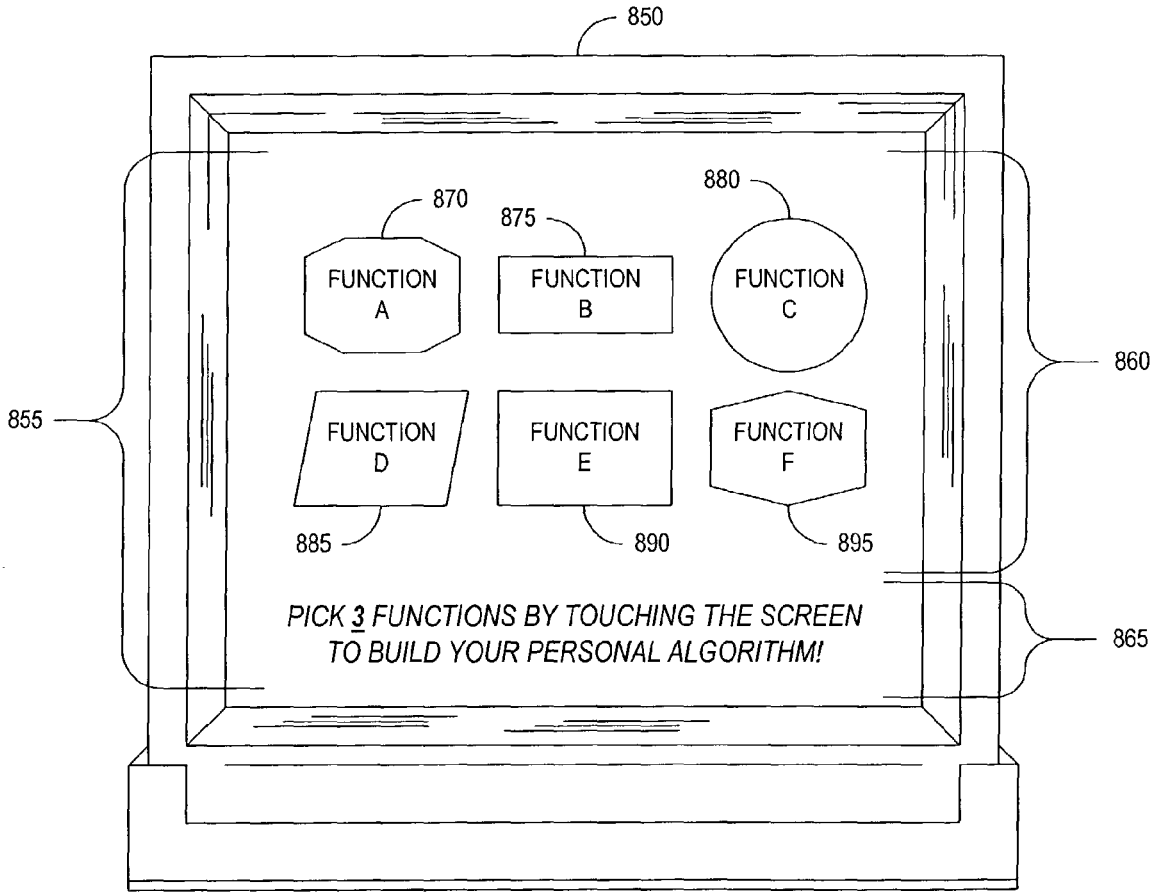
FIG. 8B is an exemplary plan view of a gaming device, depicting a screen that may be presented to a player in the one or more embodiments in which the process of FIG. 8A is utilized.

In one or more embodiments, the available functions may be displayed to the player (e.g., the variables and relationship of the variables may be displayed). In one or more embodiments, the available functions may not be displayed but may simply be represented with sufficient distinction such that the player may distinguish between one function and another without necessarily being aware of the variables and/or relationship of the variables comprising each function. The latter manner of presenting the available functions to a player is illustrated in FIG. 8B. For example, the player may be prompted to select two functions from functions "A", "B", "C" and "D", without necessarily being aware of or informed of what functions "A", "B", "C", and "D" are.

In step 810, an algorithm is determined based on the functions selected by the player. In one or more embodiments, step 810 may comprise generating an algorithm by combining the functions selected by the player (e.g., with one or more additional functions not selected by the player). In one or more embodiments, step 810 may comprise selecting an algorithm from a plurality of available algorithms such that the selected algorithm includes the functions (e.g., or at least one of the functions) selected by the player.

In step 815, a random number is determined based on the algorithm determined in step 810. In step 820, an outcome is determined based on the random number determined in step 815. Step 820 may comprise accessing a probability table and determining what outcome corresponds to the random number determined in step 815, in a manner similar to that described with respect to step 725 of process 700 (FIG. 7).

Referring now to FIG. 8B, depicted therein is an example of information that may be displayed on a screen or other display area 855 of a gaming device 10 operating in accordance with the process 800 of FIG. 8A. Alternatively, in one or more embodiments, the depicted display area 855 may be that of another device (e.g., a kiosk, customer service desk computer, or personal computer) via which a player may select functions for inclusion in an algorithm. In the latter embodiments, the player's selection(s) of function(s) may be stored in association with the player's identifier and accessed whenever the player indicates that he would like to use his selected function(s) in an algorithm to determine an outcome of a gaming device.

A display area 855 comprises a touchscreen that may be utilized to communicate information to a player and/or receive information from a player. The information depicted on display area 855 comprises a plurality of functions 870–895, in area 860 of display area 855 and an instruction message in an area 865 of display area 855.

Note that the actual functions available for selection are not depicted. Instead, each function is represented by a shape that uniquely identifies the function. Other methods of representing the functions may be utilized. For example, a unique identifier comprising one or more characters, a color, a sound, a cartoon character, the actual functions themselves, or any other means for distinguishing among the plurality of available functions may be utilized consistent with embodiments of the present invention.

In the gaming device depicted in FIG. 8B, a player may select "3" functions. The player does so by touching three of the shapes depicted on the touchscreen. Of course, other methods of indicating the player's selection of the functions may be utilized. For example, each of the functions may correspond to a key on a keypad or button of the gaming device and the player may select a particular function by actuating the key or button. In another example, the player may speak the name or description of the function the player desires to select into a microphone of the gaming device. For example, the player may say "functions C, E, and F" please.

Figure 9A:
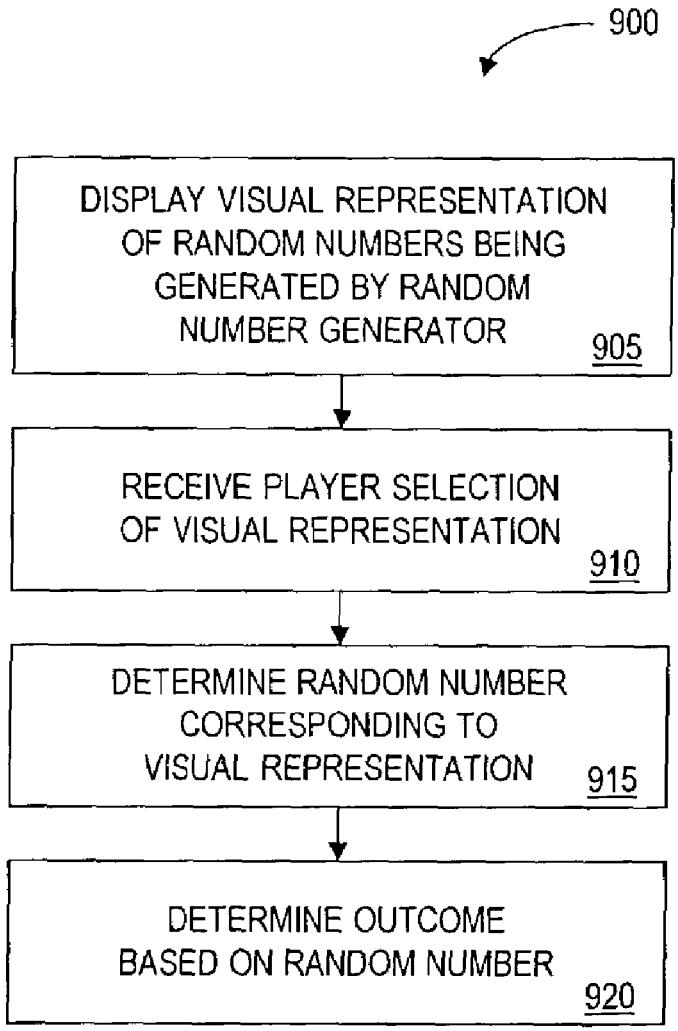
FIG. 9A is a flow chart depicting a process consistent with one or more embodiments of the present invention.

Referring now to FIG. 9A, depicted therein is a flowchart illustrating a process 900 that is consistent with one or more embodiments of the present invention. In the process 900 a player input comprises a selection of a visual representation of a random number.

In step 905, visual representations of random numbers generated by a random number generator are displayed. The visual representations may comprise representations of random numbers as they are being generated, representations of random numbers generated at a previous time, or representations of random numbers that may be generated by a random number generator.

Figure 9B:
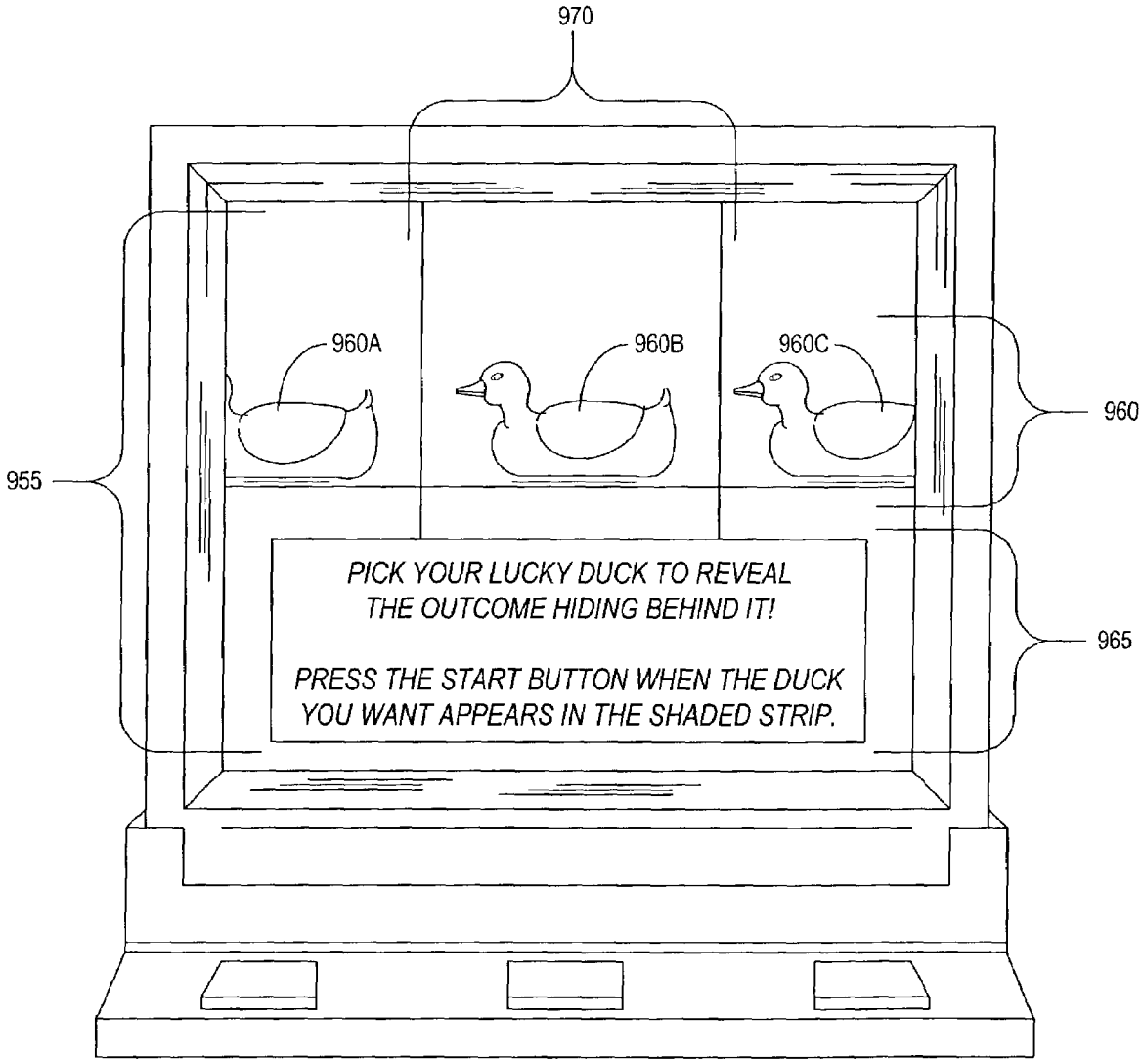
FIG. 9B is an exemplary plan view of a gaming device, depicting a screen that may be presented to a player in the one or more embodiments in which the process of FIG. 9A is utilized.

In one example, the visual representations may be displayed in a continuous stream of data such that the player has to select one of the plurality of visual representations streaming across a screen of a gaming device. Such a method for displaying the visual representations is illustrated in FIG. 9B.

In another example, the visual representations may each appear in a random area of a display of the gaming device (e.g., for one second or half a second) and the player may be required to "click" on or otherwise select the visual representation while it appears on the screen. Such embodiments may utilize some skill on the player's part. For example, the player may need quick reflexes and accuracy to click on or otherwise select the desired visual representation before it is not longer being displayed. In such an example, only one or more than one visual representation (e.g., which each may or may not be displayed for the same period of time) may be displayed simultaneously. Additionally, a player may be required to select one such displayed visual representation within a predetermined period of time (e.g., within 4 seconds of initiating a game on the gaming device). In such embodiments a random number may be selected for the player (e.g., whichever one corresponds to the visual representation being displayed at the end of the required period of time) if the player fails to select one.

In step 910, the player's selection of a visual representation is received. In step 915 the random number that corresponds to the visual representation is determined. For example, a gaming device 10 or server 8 may store in a memory (e.g., in RAM, ROM, or memory 26) an indication of random numbers and the visual representation that corresponds to each.

In step 920, an outcome is determined based on the random number determined in step 915. Determining an outcome may be done in a manner similar to that described with respect to step 820 of process 800 (FIG. 8A).

Referring now to FIG. 9B, an illustration of information that may be depicted on a screen or other display area 955 of a gaming device 10 operating in accordance with the process 900 is shown. The display area 955 comprises an area 960 in which a plurality of visual representations 960A–960C (each representing a distinct random number) are displayed as moving along the area 960 from right to left. Each of the visual representations is displayed as moving through an area 970. The instructions for selecting a visual representation, depicted in area 965, instruct a player to indicate which visual representation they desire by actuating a start button of the gaming device when their desired visual representation passes through the area 970. As described above with reference to FIG. 9A, many other methods of allowing a player to select a visual representation of a random number may be recognized by one of ordinary skill in the art after reading the present disclosure.

Note that each of the visual representations 960A–960B are depicted as being indistinguishable from one another, in the example of FIG. 9B. In one or more other embodiments, the visual representations of the random numbers may be visually distinct from one another. For example, each visual representation may be a different color, shade, shape, or be associated with a different identifier.

Note that, as described above, a random number generator may generate thousands of random numbers per second. In embodiments employing such a random number generator, it may be impractical to display a visual representation of each random number generated by the random number generator. Accordingly, only a subset of the random numbers generated by the random number generator may be output as visual representations (e.g., only one per second, or one out of every 500 random numbers generated). Alternatively, the speed with which the random number generator generates random numbers may be decreased.

Figure 10:
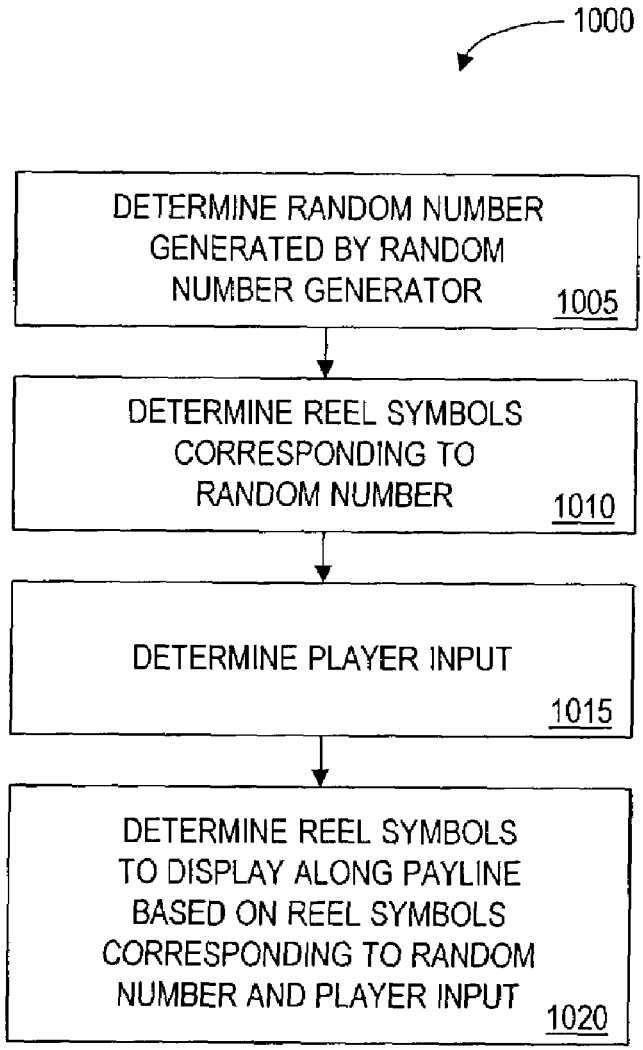
FIG. 10 is a flow chart depicting a process consistent with one or more embodiments of the present invention.

Referring now to FIG. 10, a flowchart depicts a process 1000 that is consistent with one or more embodiments of the present invention. The process 1000 illustrates a method wherein a player input is not directly combined with a random number to determine an outcome to display, or used to determined the random number that will in turn be used to determine an outcome to display. Rather, in the process 1000 a random number is used to determine a first outcome that corresponds to the random number. A second outcome, the outcome that is to be displayed along a payline of the gaming device, is then determined based on (i) the player input, and (ii) the first outcome determined based on the random number. In other words, in accordance with the process 1000, the outcome corresponding to the random number (e.g., in a probability table of gaming device 10) is not necessarily the outcome that will be displayed on the gaming device 10 as a result of the game (e.g., and based on which a payout for the game is determined).

In step 1005, a random number generated by a random number generator of a gaming device is determined. Such a random number may be determined, for example, in response to a player's initiation of a game (e.g., actuation of a start or deal button, pulling of a handle, indication of a wager amount, etc.) on the gaming device.

In step 1010 the reel position(s) corresponding to the random number is determined (e.g., from an entry in a probability table of the gaming device). However, unlike in conventional play, the gaming device may not be directed at this point to display the reel position(s) determined based on the random number. Note that, although a reeled slot machine is used to illustrate process 1000, if the gaming device instead comprises, for example, a video poker device, the step 1010 may comprise determining a set of cards to display as an initial hand, a final hand, and/or replacement cards for a video poker game.

In step 1015 a player input is determined. The player input may be received, for example, via a player input device 48 of the gaming device 10 or from a server 48. Note that, in one or more embodiments, the player input may be determined before or substantially simultaneously with the determination of the random number and/or the reel position(s) corresponding to the random number. Note further that, in one or more embodiments, the player input may need to be converted to another format before being utilized in the remainder of process 1000.

In step 1020, the reel position(s) to display along a payline of gaming device 10 are determined based on (i) the reel position(s) corresponding to the random number determined in step 1005, and (ii) the player input received in step 1015. A player input may be used, for example, to determine how the reel position(s) corresponding to the random number are to be adjusted. For example, a plurality of rules, each corresponding to a number or range of numbers, may be stored in a memory of the gaming device 10. The player input may be in the form of a number or converted to a number that matches one of the numbers corresponding to a rule or that fits within a range of numbers corresponding to a rule. In this example, the player input that is received may be used to determine which rule to apply to the reel position(s) determined based on the random number.

Examples of such rules include, but are not limited to, (i) respinning one of the reels (e.g., based on a second determined random number), (ii) moving a predetermined one of the reels by a predetermined number of positions in a predetermined direction, (iii) setting one or more of the reels to a predetermined position, and (iv) moving each of the reels by a predetermined number of positions in a predetermined direction. For example, assume that (in a three reel slot machine) the reel positions corresponding to the random number comprise the symbols "cherry-cherry-bar". Further assume that the player input corresponds to a rule that defines an adjustment of the last reel by two positions down on the reel, and the symbol two positions down on the last reel from "bar" is "cherry". In this example, applying the rule to the reel positions determined based on the random number results in the display of "cherry-cherry-cherry" along the payline of the slot machine.

In one or more embodiments, the player input need not be in a numeric format or be converted to a numeric format. For example, an image of the player's face, fingerprint, iris, hand shape, or body shape may be obtained and analyzed to determine what reel symbol it most closely resembles. The outcome for a game may then be determined such that at least one of the symbols included in the outcome comprises that symbol. For example, a random number may be determined and the outcome that corresponds to that random number determined from a probability table. The outcome may then be analyzed to determine whether it includes the symbol that most closely resembles the image associated with the player. If it does, the outcome may simply be displayed. If it does not, the outcome may be adjusted such that it does include the symbol that most closely resembles the image associated with the player (e.g., a predetermined reel may be adjusted to display the symbol along the payline).

Note that, although embodiments of the present invention have been described with reference to a random number as being generated by a random number generator of a gaming device, the invention is not so limited. Other methods for determining a random number to use for determining an outcome of a gaming device are within the scope of the present invention. For example, a service called "HotBits"™ provides random numbers that are determined by timing successive pairs of radioactive decays detected by a Geiger-Muller tube interfaced to a computer. A casino or other gaming device operator may, for example, order random numbers from such a service and utilize them to determine outcomes for gaming devices.

In accordance with one or more embodiments, a player input may comprise the random number that is used to determine an outcome for a game on a gaming device. For example, a player may be prompted to provide a number comprising a predetermined number of digits. Each possible outcome on the gaming device may correspond to a number or range of numbers in a probability table of the gaming device, as described above. Accordingly, the outcome for a game may be determined by determining which outcome the number provided by the player corresponds to. Of course, in such a system if a player inputs a number and it corresponds to an outcome that in turn corresponds to a high payout, the player would simply want to re-input or reuse the same number for subsequent games in order to keep winning the same payout. To prevent this, a player might be prevented from inputting or using the same number within the same session or within a predetermined period of time (e.g., a week). Further, the numbers or ranges of numbers that each correspond to an outcome in the probability table might be adjusted such that for each game, gaming session, or predetermined period of time (e.g., a week), a given number or range of numbers corresponds to a different outcome than it did in a previous game, gaming session, or predetermined period of time. Thus, even if the player reuses or re-inputs a number that previously corresponded to an outcome that in turn corresponded to a high payout, that number may correspond to a different payout the next time the player uses it. The numbers or ranges of numbers that each correspond to an outcome may be adjusted, for example, on a random basis. Alternatively, the numbers or ranges of numbers may be adjusted based on a predetermined rule or pattern.

In one or more embodiments, the player input may comprise the algorithm to be used to determine the random numbers. For example, the player may use a keypad to enter his personal algorithm.

In one or more embodiments, the player input may comprise the force and/or speed with which a player actuates a button, pulls a handle, presses a touchscreen area of a display, or manipulates a knob of the gaming device, In one or more embodiments, the player input may be utilized to determine what reel position(s) will not be selected as a result of the game or what symbols will not be part of the outcome. For example, a player may indicate that his least favorite symbol is "bar" or a player input may correspond to the symbol "bar". In such embodiments, an outcome selected based on a random number may be adjusted as necessary such that it does not include such a symbol. In one or more embodiments, the gaming device may determine a different symbol not to include in an outcome for a game for each respective game played on the gaming device (e.g., based on the same or different player input for each game).

Inputs that are in addition to a random number but not necessarily within the control of the player may also be used to determine an outcome for a game of a gaming device. Examples of such inputs include, but are not limited to: (i) the reel position(s) of a previous game, (ii) the pattern or force with which coins from a hopper fall into a tray of a gaming device, (iii) inputs from players of gaming devices other than the one currently being played by the subject player (e.g., an average of the player inputs provided on predetermined gaming devices within a predetermined period of time may be calculated), (iv) random numbers generated by one or more other gaming devices (e.g., one or more gaming devices located in geographical proximity to the subject gaming device), and/or (v) an algorithm or seed used by a gaming device previously played by the player (e.g., if a player liked the outcomes obtained on the gaming device previously played, the player may wish to transfer the algorithm or seed used by the gaming device previously played to another gaming device the player is about to play). Such a transfer may be performed by, for example, storing an identifier of a gaming device being played by a player in association with the player's identifier (e.g., at server 8, based on the player tracking card inserted into the gaming device). If, at a point later in time, the player desires to utilize the algorithm or seed used by the previously played gaming device, such seed or algorithm may be determined (e.g., by the server 8) by querying the previously played gaming device for the data or looking up the data in a database of gaming device data. The data (e.g., the algorithm or seed) may then be communicated to the gaming device the player desires to play and that gaming device instructed to use the data during the player's game play.

Regarding example (iii) above, in one or more embodiments a player at a first gaming device may provide a player input that is used at the first gaming device and at least one second device. For example, a pod of gaming devices may be provided with the player input. If a winning outcome (e.g., an outcome that corresponds to a payout) is obtained on one of the at least one second gaming devices, the player that provided the player input may be notified of the obtainment of this outcome. This may allow the player to feel good about helping another player win a payout. Further, other players (e.g., players playing the at least one second gaming device) may be notified of the obtainment of the winning outcome and of which player provided the player input used in obtaining the winning outcome. In one or more embodiments, the player that provided the player input used in obtaining the winning outcome at the at least one second gaming device may be provided with a benefit as a result of the winning outcome. Such a benefit may comprise, for example, (i) a portion of the payout, (ii) coins, bills, tokens or electronic credits (e.g., in an amount that is a percentage of the payout of the winning outcome), (iii) comp points, and/or (iv) products or services (e.g., a free drink from the casino in which the gaming devices are located and/or a free game on a gaming device).

In one or more embodiments, more than one player input may be utilized to determine an outcome for a game of a gaming device. For example, a player may provide one input that is utilized over a plurality of game (e.g., one which is stored in association with the player's identifier and used for each game played by the player) and another input that is provided at the initiation of each game played by the player.

In one or more embodiments, a player may be prompted to re-enter a player input or to confirm a player input previously provided by the player. Such a prompt may be output to the player, for example, every predetermined number of games (e.g., every 10 games) and/or every predetermined period of time (e.g., every 10 minutes). Such prompting may aid in convincing the player that the player input is an important part of game play and of determining outcomes for the gaming device the player is playing. If the player is so convinced, the player may be more likely to want to play a gaming device that utilizes player inputs.

In one or more embodiments, it may be desired to explicitly illustrate to the player that the player input he provided is affecting the outcome(s) obtained on the gaming device. In one or more embodiments where a player provides a player input (e.g., selects an algorithm), the gaming device may output the outcome determined based on the player input as well as an indication of what outcome would have been determined without the player input. For example, assuming the player input is a selection of an algorithm, the gaming device may output the outcome determined using the algorithm selected by the player as the result of the game and also display an indication of what the outcome would have been if a different algorithm had been utilized. Alternatively, assuming the player input is a value for a variable in an algorithm used to determine an outcome, the gaming device may output the outcome determined based on the value provided by the player as the result of the game along with an indication of what the outcome would have been if a different value had been provided by the player. In one example, the gaming device may, for example, indicate to the player an outcome that another player obtained on another gaming device by, for example, selecting a different algorithm or providing a player input of a different value for use as a value in a variable of the same algorithm the gaming device of the subject player.

In one or more embodiments, a pod of gaming device may share the same random number generator or algorithm. For example, a single random number generator may provide pseudorandom values for use in determining an outcome to each of the pod of gaming devices as necessary. In such embodiments, even if the same pseudorandom value happens to be provided to two or more gaming devices (e.g., because games were initiated simultaneously on the gaming devices), if the pseudorandom value is combined with a player input in order to obtain the numeric output that corresponds to an outcome, the outcome obtained on each of the gaming devices may be different because each of the players may have provided a different player input. The fact that the same random number generator or algorithm was utilized or that the same pseudorandom value was used to obtain different outcomes may be communicated to the player playing the gaming devices, in order to illustrate to the players that their respective player inputs resulted in different outcomes.

In one or more embodiments, the player may be allowed to reassure himself that the player input he provided affected the outcome. For example, the player may be allowed to re-determine an outcome, after an outcome is determined based on a player input, by inputting a different player outcome and being informed of what the outcome would have been if the player had initially provided this different outcome. The player may or may not be provided with any payout that may correspond to the re-determined outcome. For example, if a player desires to be provided with any payout that may correspond to the re-determined outcome, the player may need to provide additional funds (funds in addition to the wager originally provided for the game) when requesting the re-determination of the outcome.

In one or more embodiments, the methods of the present invention may be employed by an operator of an online casino or in software that simulates play of casino games. In such embodiments, a gaming device may comprise a personal computer or other computing device operated by the player. Further, in such embodiments the player input may comprise, for example, keyboard strokes of the player (e.g., the speed, pattern, or force with which the player actuates the keyboard keys) or movements of a mouse by the player.

Although the present invention has been described in terms of certain expressly described embodiments, other embodiments that are apparent to those of ordinary skill in the art after reading the present disclosure are also intended to be within the scope of the present invention.

What is claimed is:

1. A method comprising:

receiving a player input, wherein receiving the player input comprises:

receiving a biometric measurement associated with a player; and converting the biometric measurement to a numeric format;

inserting the player input as a value for a variable in an algorithm;

generating a pseudorandom output using the algorithm, such that the numeric pseudorandom output is generated as a function of at least the player input; and determining an outcome for a game of a gaming device based on the numeric pseudorandom output.

2. An apparatus comprising:

a processor, and a memory that stores a program for directing the processor;

the processor being operative with the program to:

receive a player input by being adapted to:

receive a biometric measurement associated with a player; and convert the biometric measurement to a numeric format;

insert the player input as a value for a variable in an algorithm;

generate the a pseudorandom output using the algorithm, such that the numeric pseudorandom output is generated as a function of at least the player input; and determine an outcome for a game of a gaming device based on the numeric pseudorandom output.

3. A computer readable medium encoded with instructions for directing a processor to:

receive a player input by being adapted to:

receive a biometric measurement associated with a player; and convert the biometric measurement to a numeric format;

insert the player input as a value for a variable in an algorithm;

generate the a pseudorandom output using the algorithm, such that the numeric pseudorandom output is generated as a function of at least the player input; and determine an outcome for a game of a gaming device based on the numeric pseudorandom output.

4. A method comprising:

receiving a selection of one of a plurality of algorithms that a player of a gaming device desires to be used to determine a random number for a game of the gaming device;

determining a random number that was generated using the algorithm selected by the player; and determining an outcome for the game based on the random number.

5. The method of claim 4, wherein the step of determining a random number comprises:

generating a random number using the algorithm selected by the player.

6. The method of claim 4, wherein the step of determining a random number comprises:

selecting, from a table of random numbers generated using the algorithm selected by the player, one of the random numbers stored in the table.

7. The method of claim 4, wherein the step of receiving a selection of an algorithm comprises:

receiving a selection of at least one function that a player of a gaming device desires to be included in an algorithm to be used to determine a random number for a game of the gaming device; and determining an algorithm that includes the selected at least one function.

8. The method of claim 7, wherein the step of determining an algorithm comprises:

generating an algorithm that includes the selected at least one function.

9. The method of claim 7, wherein the step of determining an algorithm comprises:

selecting, from a plurality of available algorithms, an algorithm that includes the selected at least one function.

10. The method of claim 4, wherein the step of receiving a selection of at least one function comprises:

receiving a selection of a representation of at least one function that a player of a gaming device desires to be included in an algorithm to be used to determine a random number for a game of the gaming device.

11. The method of claim 10, further comprising:

outputting a plurality of representations, each representation corresponding to one function available for inclusion in an algorithm.

12. The method of claim 4, wherein the step of receiving a selection of at least one function comprises:

receiving a player input, wherein the player input comprises at least one of a biometric input, a physical measurement, and a numeric input; and determining which of a plurality of functions available for inclusion in an algorithm the player input corresponds to.

13. The method of claim 12, further comprising:

converting the player input to a predetermined format.

14. An apparatus comprising:

a processor, and a memory that stores a program for directing the processor;

the processor with the program adapted to:

receive a selection of one of a plurality of algorithms that a player of a gaming device desires to be used to determine a random number for a game of the gaming device;

determine a random number that was generated using the algorithm selected by the player; and determine an outcome for the game based on the random number.

15. The apparatus of claim 14, wherein the processor with the program adapted to determine a random number is further adapted to:

generate the random number using the algorithm selected by the player.

16. The apparatus of claim 14, wherein the processor with the program adapted to determine a random number is further adapted to:

select, from a table of random numbers generated using the algorithm selected by the player, one of the random numbers stored in the table.

17. The apparatus of claim 14, wherein the processor with the program adapted to receive a selection of an algorithm is further adapted to:

receive a selection of at least one function that the player of a gaming device desires to be included in an algorithm to be used to determine the random number for a game of the gaming device; and determine an algorithm that includes the selected at least one function.

18. The apparatus of claim 17, wherein the processor with the program adapted to determine an algorithm is further adapted to:

generate an algorithm that includes the selected at least one function.

19. The apparatus of claim 17, wherein the processor with the program adapted to determine an algorithm is further adapted to:

select, from a plurality of available algorithms, an algorithm that includes the selected at least one function.

20. The apparatus of claim 14, wherein the processor with the program adapted to receive a selection of at least one function is further adapted to:

receive a selection of a representation of at least one function that a player of a gaming device desires to be included in an algorithm to be used to determine a random number for a game of the gaming device.

21. The apparatus of claim 20, wherein the processor with the program is further adapted to:

output a plurality of representations, each representation corresponding to one function available for inclusion in an algorithm.

22. The apparatus of claim 14 wherein the processor with the program adapted to receive a selection of at least one function is further adapted to:

receive a player input, wherein the player input comprises at least one of a biometric input, a physical measurement, and a numeric input; and determine which of a plurality of functions available for inclusion in an algorithm the player input corresponds to.

23. The apparatus of claim 22 wherein the processor with the program is further adapted to:

convert the player input to a predetermined format.

24. A computer readable medium encoded with instructions for directing a processor to:

receive a selection of one of a plurality of algorithms that a player of a gaming device desires to be used to determine a random number for a game of the gaming device;

determine a random number that was generated using the algorithm selected by the player; and determine an outcome for the game based on the random number.

25. The computer readable medium of claim 24 wherein the instructions to the processor to determine a random number comprise further instructions to:

generate a random number using the algorithm selected by the player.

26. The computer readable medium of claim 24 wherein the instructions to the processor to determine a random number comprise further instructions to:

select, from a table of random numbers generated using the algorithm selected by the player, one of the random numbers stored in the table.

27. The computer readable medium of claim 24 wherein the instructions to the processor to receive a selection of an algorithm comprise further instructions to:

receive a selection of at least one function that a player of a gaming device desires to be included in an algorithm to be used to determine a random number for a game of the gaming device; and determine an algorithm that includes the selected at least one function.

28. The computer readable medium of claim 27 wherein the instructions to the processor to determine an algorithm comprise further instructions to:

generate an algorithm that includes the selected at least one function.

29. The computer readable medium of claim 27 wherein the instructions to the processor to determine an algorithm comprise further instructions to:

select, from a plurality of available algorithms, an algorithm that includes the selected at least one function.

30. The computer readable medium of claim 24 wherein the instructions to the processor to receive a selection of at least one function comprise further instructions to:

receive a selection of a representation of at least one function that a player of a gaming device desires to be included in an algorithm to be used to determine a random number for a game of the gaming device.

31. The computer readable medium of claim 24 comprising further instructions to:

output a plurality of representations, each representation corresponding to one function available for inclusion in an algorithm.

32. The computer readable medium of claim 24 wherein the instructions to the processor to receive a selection of at least one function comprise further instructions to:

receive a player input, wherein the player input comprises at least one of a biometric input, a physical measurement, and a numeric input; and determine which of a plurality of functions available for inclusion in an algorithm the player input corresponds to.

33. The computer readable medium of claim 24 comprising further instructions to:

convert the player input to a predetermined format.

* * * * *